US010077585B2

(12) United States Patent
Lee

(10) Patent No.: US 10,077,585 B2
(45) Date of Patent: Sep. 18, 2018

(54) TAILGATE INNER HANDLE ASSEMBLY AND METHOD OF MOVING GRIP MEMBER OF THE SAME

(71) Applicant: Hyundai Motor Company, Seoul (KR)

(72) Inventor: Ho Sang Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 377 days.

(21) Appl. No.: 14/884,648

(22) Filed: Oct. 15, 2015

(65) Prior Publication Data

US 2016/0312501 A1 Oct. 27, 2016

(30) Foreign Application Priority Data

Apr. 24, 2015 (KR) ..... 10-2015-0057748

(51) Int. Cl.

| | |
|---|---|
| ***E05B 3/00*** | (2006.01) |
| ***E05B 85/12*** | (2014.01) |
| ***E05B 79/20*** | (2014.01) |
| ***E05B 85/10*** | (2014.01) |
| *E05B 1/00* | (2006.01) |
| *E05B 83/18* | (2014.01) |

(52) U.S. Cl.

CPC ..... *E05B 85/12* (2013.01); *E05B 79/20* (2013.01); *E05B 85/107* (2013.01); *E05B 1/0038* (2013.01); *E05B 83/18* (2013.01); *Y10T 16/455* (2015.01)

(58) Field of Classification Search

CPC . Y10T 16/455; Y10T 16/4554; Y10T 16/513; E05B 85/12; E05B 85/107; E05B 1/0038

USPC ..... 292/336.3; 296/1.02, 56, 57.1, 106

See application file for complete search history.

(56) References Cited

U.S. PATENT DOCUMENTS

| | | | | | |
|---|---|---|---|---|---|
| 3,572,870 | A * | 3/1971 | Marks | A45C 13/22 | 16/405 |
| 5,530,990 | A * | 7/1996 | Chen | A45C 13/22 | 16/113.1 |
| 5,549,337 | A * | 8/1996 | McCulloch | E05B 47/0012 | 292/201 |
| 5,556,152 | A * | 9/1996 | Dunlap | B62D 33/0273 | 296/180.1 |
| 5,624,012 | A * | 4/1997 | Wang | A45C 13/262 | 16/113.1 |
| 5,816,374 | A * | 10/1998 | Hsien | A45C 5/14 | 16/405 |
| 6,152,502 | A * | 11/2000 | Rossi | B60J 5/101 | 292/347 |
| 6,341,809 | B1 * | 1/2002 | Chapman | E05F 1/1058 | 296/146.8 |

(Continued)

FOREIGN PATENT DOCUMENTS

| | | |
|---|---|---|
| KR | 20-1998-0050515 U | 10/1998 |
| KR | 20-0144108 Y | 6/1999 |

(Continued)

*Primary Examiner* — Carlos Lugo

(74) *Attorney, Agent, or Firm* — Morgan, Lewis & Bockius LLP

(57) ABSTRACT

A tailgate inner handle assembly may include a grip member being movable in a lower end of a tailgate, an actuator moving the grip member to a first position when the tailgate is opened and moving the grip member to a second position the tailgate is closed, and at least one driving wires driving the actuator when opening and closing the tailgate.

16 Claims, 7 Drawing Sheets

(56) References Cited

U.S. PATENT DOCUMENTS

| | | | | |
|---|---|---|---|---|
| 6,416,115 | B2 * | 7/2002 | Ader | B60J 5/10 292/336.3 |
| 6,550,102 | B1 * | 4/2003 | Liang | A45C 13/262 16/113.1 |
| 6,758,513 | B2 * | 7/2004 | Choo | B60J 5/101 292/216 |
| 6,793,264 | B1 * | 9/2004 | Muller | E05F 1/1091 16/71 |
| 6,805,386 | B2 * | 10/2004 | Ehret | E05B 81/20 292/141 |
| 7,905,523 | B2 * | 3/2011 | Stefanic | E05B 17/0004 292/201 |
| 8,469,411 | B2 * | 6/2013 | Costigan | E05B 85/16 292/336.3 |
| 8,608,221 | B1 * | 12/2013 | Krajenke | E05B 79/20 292/DIG. 72 |
| 8,684,435 | B1 * | 4/2014 | Lee | E05B 81/06 16/110.1 |
| 8,915,524 | B2 * | 12/2014 | Charnesky | E05B 79/20 292/216 |
| 2007/0138802 | A1 * | 6/2007 | Stasko | E05B 81/14 292/201 |
| 2014/0097633 | A1 | 4/2014 | Lee | |

FOREIGN PATENT DOCUMENTS

| | | | |
|---|---|---|---|
| KR | 10-0376834 | B1 | 3/2003 |
| KR | 10-0380447 | B1 | 4/2003 |
| KR | 10-2007-0013741 | A | 1/2007 |
| KR | 10-1163469 | B | 6/2012 |
| KR | 10-1327737 | B | 11/2013 |

* cited by examiner

TAILGATE INNER HANDLE ASSEMBLY AND METHOD OF MOVING GRIP MEMBER OF THE SAME

CROSS-REFERENCE TO RELATED APPLICATION

The present application is based on and claims the benefit of priority to Korean Patent Application No. 10-2015-0057748, filed on Apr. 24, 2015, the entire contents which is incorporated herein for all purposes by this reference.

BACKGROUND OF THE INVENTION

Field of the Invention

The present disclosure relates to a tailgate inner handle assembly, and more particularly, to a tailgate inner handle assembly having a grip portion configured to automatically move to a first position when a tailgate is opened, thus allowing a user who is short to simply grasp the grip portion when the user intends to close the tailgate, and a method of moving a grip member of the same.

Description of Related Art

A loading space for loading articles is provided at a rear side of a vehicle such as a sport utility vehicle (SUV) or a multi-purpose vehicle (MPV), and an opening of the loading space may be opened and closed by a tailgate.

The tailgate is installed to pivot from an upper end of a rear side of a vehicle to circumscribe a horizontal axis, and an inner handle assembly is installed in a lower end of the tailgate in order to easily close the tailgate.

The inner handle assembly has various structures such as a trim integrated type, a panel insertion type, and a grip type, and may be selectively applied according to types of vehicles or specifications of vehicles.

However, with the tailgate opened, since the inner handle assembly of the tailgate is positioned to be high, a short user cannot easily grab the inner handle assembly.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a tailgate inner handle assembly having a grip portion configured to automatically move to a first position when a tailgate is opened, thus allowing a short user to simply grab the grip portion when the user intends to close the tailgate, and a method of moving a grip member of the same.

According to an exemplary embodiment of the present disclosure, a tailgate inner handle assembly includes: a grip member installed to be movable in a lower end of a tailgate; an actuator moving the grip member to a first position when the tailgate is opened and moving the grip member to a second position when the tailgate is closed; and a driving wire driving the actuator when the tailgate is opened or closed.

The actuator may include: a pulley rotating in a first direction when the driving wire is wound, and rotating in a second direction when the driving wire is unwound; and a cylinder unit moving the grip member by the pulley rotating in the first position or in the second position.

The tailgate inner handle assembly may further include: a bracket being fixed to the lower end of the tailgate, wherein the pulley and the cylinder unit are installed on the bracket.

The cylinder unit may include: a cylinder being installed on the bracket; and a piston being installed to move forward and backward with respect to the cylinder.

The grip member may be fixed to the piston, the piston may be connected to the pulley by the driving wire, and the piston may move forward and backward by integrally operating with the pulley.

A moving member may be connected to one side of the piston and installed to move forward and backward by integrally operating with the driving wire and the pulley.

The moving member may be coupled to penetrate through the piston in a radial direction of the piston and the cylinder have a guide slot guiding the forward and backward movement of the moving member in a longitudinal direction of the cylinder.

A first elastic member applying elastic force to the piston may be installed within the cylinder.

The first elastic member may apply elastic force in a direction in which the moving member moves away from the bracket.

A retainer may be interposed between one end of the first elastic member and the moving member.

The driving wire may include a first driving wire connected from an upper roof portion of a vehicle to the pulley through inside an interior of the tailgate and a second driving wire connected from the moving member to the pulley.

The first driving wire and the second driving wire may be wound around an outer circumferential surface of the pulley, and when the tailgate is opened and the first driving wire is pulled, the first and second driving wires may be unwound from the outer circumferential surface of the pulley and the moving member and the piston move away from the bracket.

The pulley may be installed to rotate in a winding direction when the first and second driving wires are wound or in an unwinding direction when the first and second driving wires are unwound, and the pulley may be configured to receive elastic force to rotate in the winding direction by a second elastic member.

The second elastic member may be a torsion spring applying circumferential directional elastic force.

The pulley may be provided to have a first winding portion in which the first driving wire is wound around an outer circumferential surface thereof and a second winding portion in which the second driving wire is wound around the outer circumferential surface thereof.

The tailgate inner handle assembly may further include a guide device guiding the second driving wire.

The guide device may include a guide rib provided at one side of the bracket and a guide member coupled to the guide rib, and the guide member may have a guide hole in which the second driving wire is guided.

According to another exemplary embodiment of the present disclosure, a tailgate inner handle assembly includes: a bracket being fixed to a lower end of a tailgate; a pair of cylinders being fixed to the bracket and each having a hollow portion therein; a pair of pistons being installed to move forward and backward in the hollow portions of the pair of cylinders; a pair of first elastic members being installed within the pair of cylinders, and applying elastic force in a direction moving away from the bracket; a grip member being connected to the pair of pistons; a moving member being installed between the pair of pistons to connect one piston to the other piston; and a pulley being installed to rotate in the bracket and allowing a first driving wire and a second driving wire to be wound around an outer circumferential surface thereof, wherein one end of the first driving wire is fixed to an upper roof portion of a vehicle and the other end of the first driving wire is fixed to be wound around the pulley, and one end of the second driving wire is fixed to the central portion of the moving member and the other end of the second driving wire is fixed to be wound around the pulley.

According to another exemplary embodiment of the present disclosure, a method of moving a grip member of a tailgate inner handle assembly including a grip member installed in a lower end of a tailgate, an actuator moving the grip member, and a driving wire driving the actuator when the tailgate is opened, includes: pulling the driving wire when the tailgate is opened; driving the actuator by the pulling the driving wire; and moving the grip member to a first position in the lower end of the tailgate by the driving the actuator.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
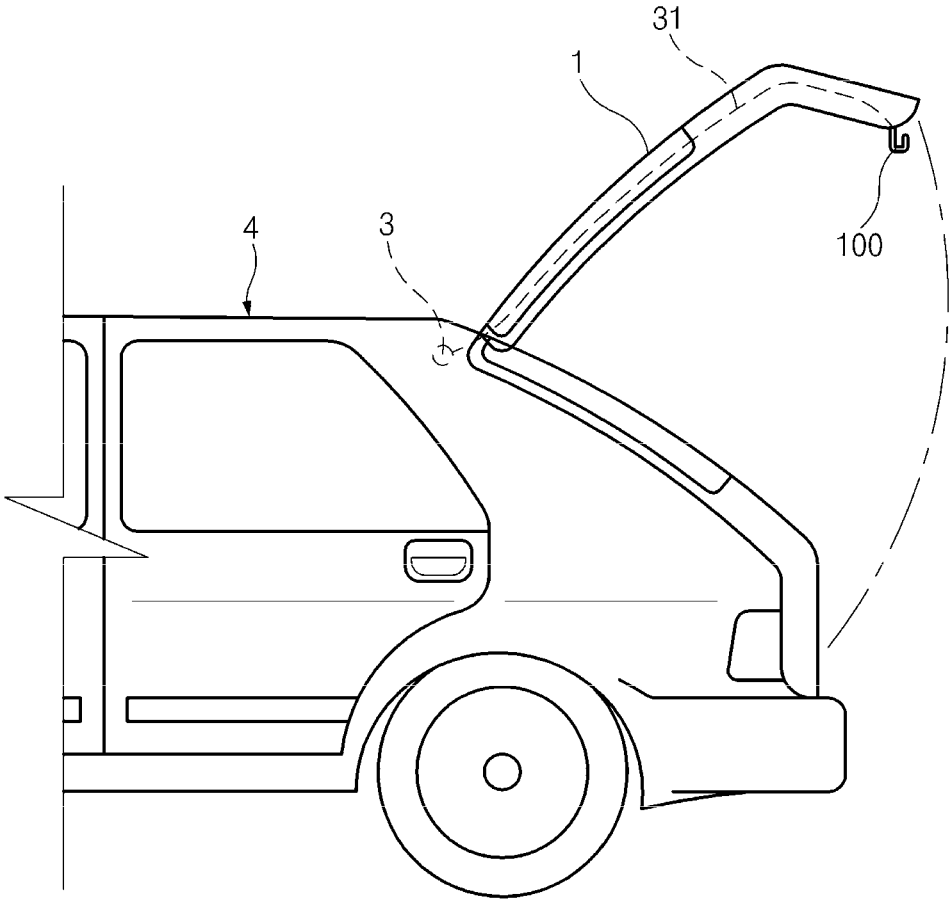
FIG. 1 is a view illustrating operational states of opening and closing a tailgate employing a tailgate inner handle assembly according to an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIGS. 1 through 7 are views illustrating a tailgate inner handle assembly according to an exemplary embodiment of the present disclosure.

Figure 2:
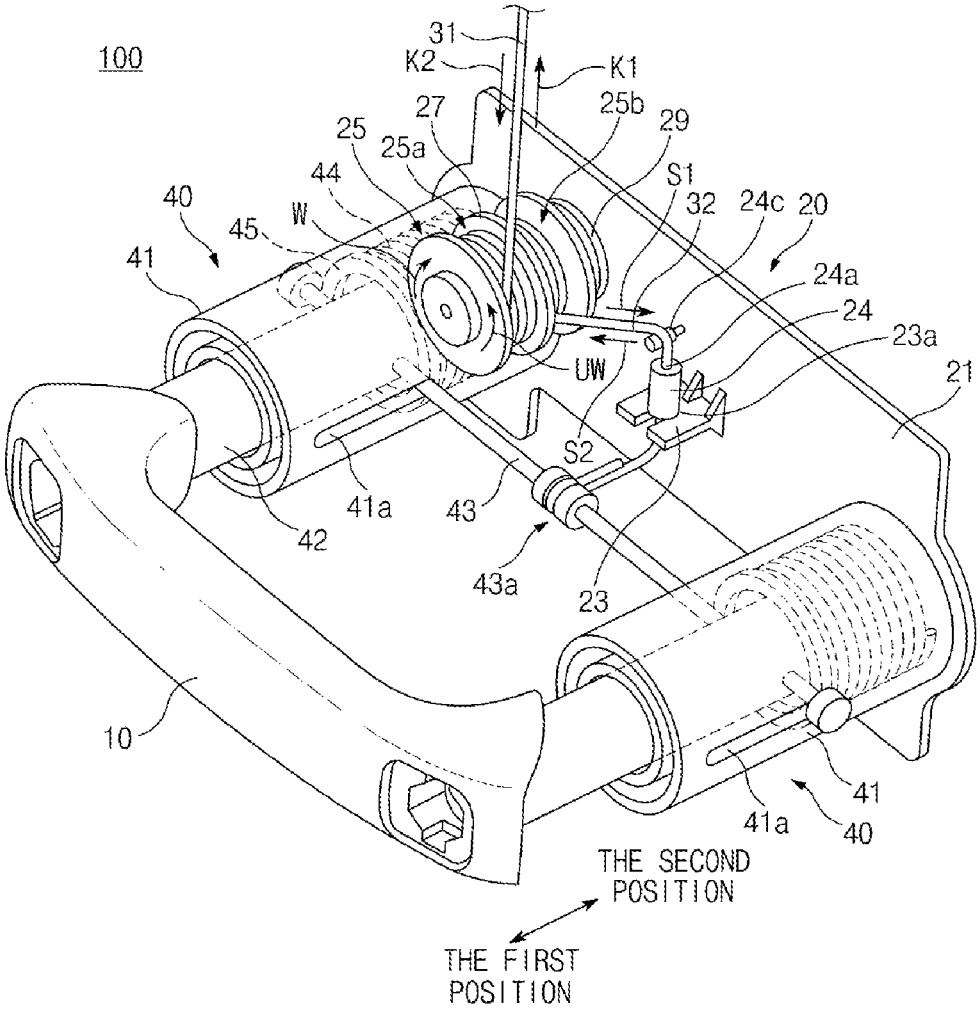
FIG. 2 is a perspective view illustrating a tailgate employing a tailgate inner handle assembly according to an exemplary embodiment of the present disclosure.

Referring to FIGS. 1 and 2, a tailgate inner handle assembly 100 according to an exemplary embodiment of the present disclosure includes a grip member 10 installed to be movable in a lower end of a tailgate 1, an actuator 20 moving the grip member 10 when opening or closing the tailgate 1, and one or more driving wires 31 and 32 driving the actuator 20 when opening or closing the tailgate 1.

Figure 6:
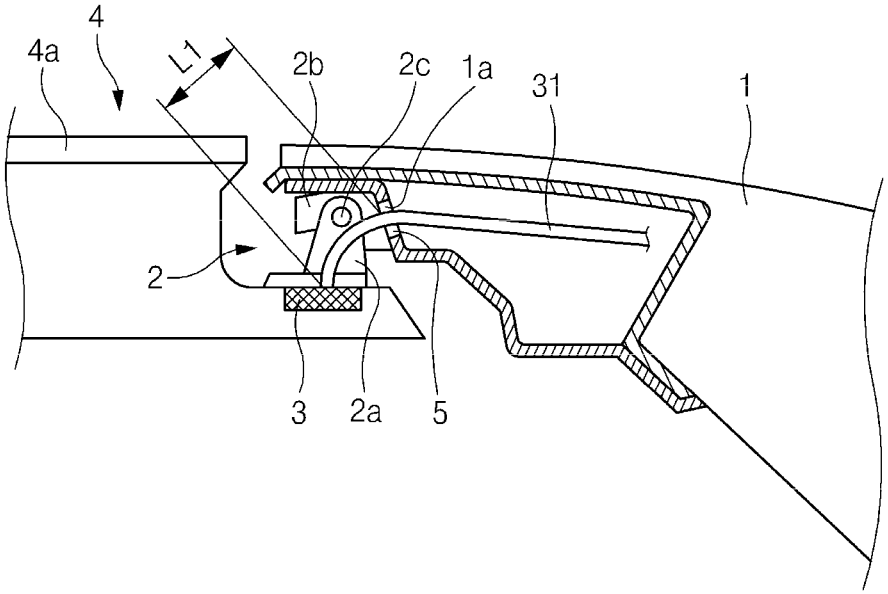
FIG. 6 is a view illustrating a state in which a driving wire of a tailgate inner handle assembly according to an exemplary embodiment of the present disclosure is installed between a tailgate adjacent to a hinge mechanism and a rear side of a vehicle, in which the tailgate has closed the rear side of the vehicle.
Figure 7:
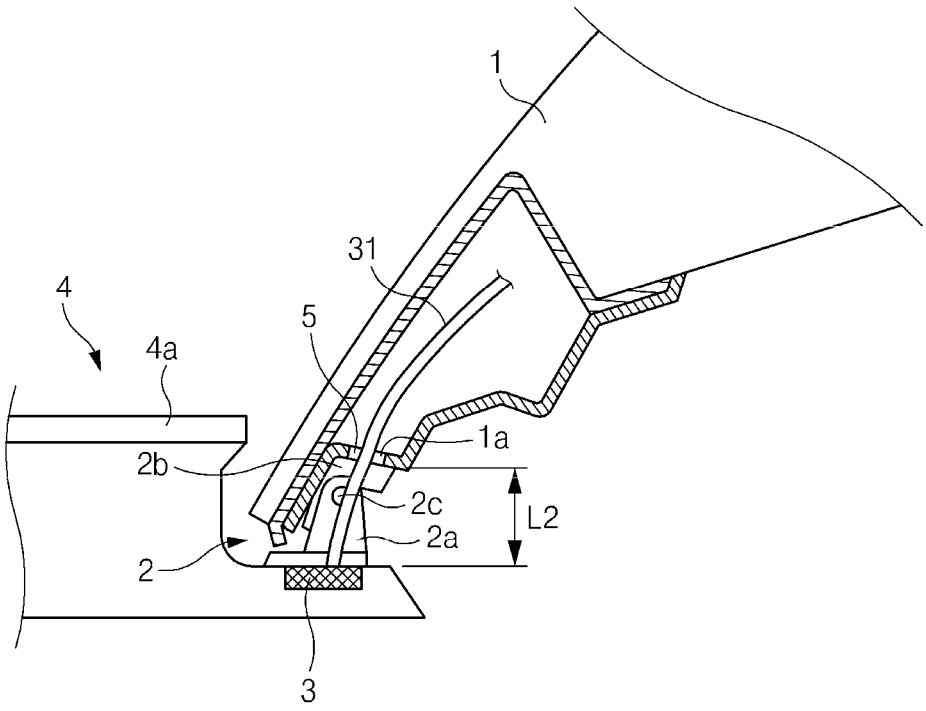
FIG. 7 is a view illustrating a state in which a driving wire of a tailgate inner handle assembly according to an exemplary embodiment of the present disclosure is installed between a tailgate adjacent to a hinge mechanism and a rear side of a vehicle, in which the tailgate has opened the rear side of the vehicle.

As illustrated in FIG. 1, the tailgate 1 is installed at the rear of a vehicle 4 such that it can be opened or closed, and in particular, as illustrated in FIGS. 6 and 7, an upper end of the tailgate 1 is installed to pivot with respect to the upper roof portion of the vehicle 4 by the medium of a hinge mechanism 2.

As illustrated in FIG. 1, the grip member 10 is installed at the rear end of the tailgate 1. The grip member 10 is configured to be movable with respect to the lower end of the tailgate 1 by the actuator 20 as described hereinafter.

Figure 3:
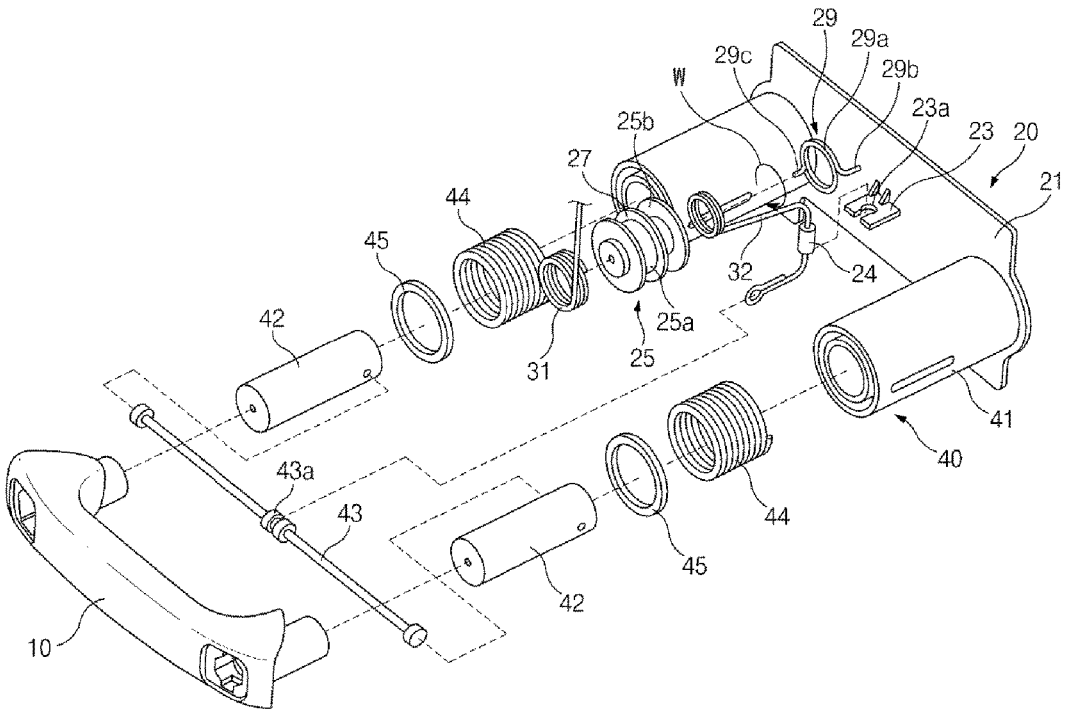
FIG. 3 is an exploded perspective view illustrating a tailgate employing a tailgate inner handle assembly according to an exemplary embodiment of the present disclosure.

As illustrated in FIGS. 2 and 3, the actuator 20 includes a bracket 21, a pulley 25 rotatably installed on the bracket 21, and a cylinder unit 40 moving the grip member 10 by integrally operating with the pulley 25 that rotates.

The bracket 21 is fixed to one side of the lower end of the tailgate 1 through a fastening member or welding. For example, an inwardly recessed portion may be formed at one side of the lower end of the tailgate 1, the bracket 21 may be fixed to the recessed portion, and the grip member 10 may be easily moved in the recessed portion of the lower end of the tailgate 1 by the actuator 20.

As the pulley 25 and the cylinder unit 40 are installed on the bracket 21, the pulley 25 and the cylinder unit 40 are assuredly installed stably in the lower end of the tailgate 1.

The pulley 25 is installed to be rotatable by the medium of a rotational shaft on the bracket 21. The pulley 25 is configured to rotate in a first direction when one or more driving wires 31 and 32 are wound around an outer circumferential surface of the pulley 25, and to rotate in a second direction when the driving wires 31 and 32 are unwound therefrom.

According to an exemplary embodiment, as illustrated in FIG. 2, when the driving wires 31 and 32 are wound around the pulley 25 (please refer to directions of the arrows K2 and S2 of FIG. 2), the pulley 25 rotates in a winding direction (please refer to a direction of the arrow W of FIG. 2) due to winding force of the driving wires 31 and 32. When the driving wires 31 and 32 are unwound from the pulley 25 (please refer to directions of the arrows K1 and S1 of FIG.

2), the pulley 25 rotates in an unwinding direction (please refer to a direction of the arrow UW of FIG. 2) due to unwinding force of the driving wires 31 and 32.

According to an exemplary embodiment, as described hereinafter, the driving wires 31 and 32 may be configured to be wound around the pulley 25 when the tailgate 1 is closed, and to be unwound from the pulley 25 when the tailgate 1 is opened.

The cylinder unit 40 is installed on one surface of the bracket 21 and configured to allow the grip member 10 to move by the rotation of the pulley 25 which integrally operates with the driving wires 31 and 32.

As illustrated in FIGS. 2 and 3, the cylinder unit 40 includes a cylinder 41 fixed to the bracket 21 and a piston 42 installed to move forward and backward with respect to the cylinder 41.

The cylinder 41 has a hollow portion therein, and a first elastic member 44 elastically pushing the piston 42 is installed in the hollow portion of the cylinder 41.

In particular, when the driving wires 31 and 32 are unwound from the pulley 25, the first elastic member 44 may move the piston 42 forward by elastic force thereof such that the piston 42 is pushed away from the bracket 21. Conversely, when the driving wires 31 and 32 are wound around the pulley 25, a portion of the driving wire 32 is wound around the pulley 25 to pull the piston 42 toward the bracket 21 such that the piston 42, while overcoming the elastic force of the first elastic member 44, moves backward, and the first elastic member 44 is compressed by such backward force of the piston 42.

That is, when the tailgate 1 is opened, the driving wires 31 and 32 are unwound and the piston 42 moves forward by virtue of elastic force of the first elastic member 44, and when the tailgate 1 is closed, the driving wires 31 and 32 are wound to move the piston 42 backward.

According to an exemplary embodiment, the first elastic member 44 includes a coil spring and may be configured to push the piston 42 away from the bracket by elastic force thereof. A retainer 45 is disposed to be in contact with one end of the first elastic member 44, and the other end of the first elastic member 44 is supported by the bracket 21.

The piston 42 is inserted in the hollow portion of the cylinder 41 and installed to move backward and forward, and a moving member 43 is connected to the piston 42. The moving member 43 moves forward and backward by integrally operating with the driving wires 31 and 32 and the pulley 25, and thus, the piston 42 may move forward and backward together with the moving member 43.

The moving member 43 is coupled between the pistons 42 such that one piston is connected to the other piston. A guide slot 41*a* guiding forward and backward movement of the moving member 43 in a longitudinal direction of the cylinder 41 is formed. In particular, the guide slot 41*a* is limited to have a predetermined length, and accordingly, a forward/backward stroke of the moving member 43 is appropriately regulated from a front end of the guide slot 41*a* to a rear end. Through the regulation of the forward/backward stroke of the moving member 43, a movement of the grip member 10 may be appropriately regulated.

Meanwhile, the retainer 45 may be interposed between one side of the moving member 43 and one end of the first elastic member 44, and due to the disposition structure of the retainer 45, the first elastic member 44 may be stably maintained in the hollow portion of the cylinder 41 when compressed and expanded.

Also, the grip member 10 is connected to an outer end of the piston 42, and as the piston 42 moves forward and backward, the grip member 10 may be moved in the lower end of the tailgate 1.

According to an exemplary embodiment, as illustrated in FIGS. 2 through 5, the cylinder unit 40 includes a pair of cylinders 41 symmetrically fixed to one surface of the bracket 21, a pair of pistons 42 installed to move forward and backward individually with respect to their respective cylinders 41, and a pair of first elastic members 44 applying elastic force in a movement direction of the pistons 42 within their respective cylinders 41.

The moving member 43 is coupled between the pair of pistons 42 to connect one piston to the other piston, and a fixing unit 43*a* fixing one end of the second driving wire 32 is prepared in the central portion of the moving member 43.

Both ends of the grip member 10 are coupled to outer ends of the pair of pistons 42 through fastening members, or the like.

Since the cylinders 41, the pistons 42, and the first elastic members 44 are symmetrically disposed with respect to the bracket 21, the grip member 10 may be more stably and smoothly moved.

The driving wires 31 and 32 include the first driving wire 31 connected from the upper roof portion of the vehicle 4 to the pulley 25 and the second driving wire 32 connected from the pulley 25 to the moving member 43.

As illustrated in FIG. 1, the first driving wire 31 is connected from the rear of the vehicle 4 to the pulley 25 through inside the tailgate 1, and one end of the first driving wire 31 is fixed to the upper roof portion of the vehicle 4 through a fixture 3. The other end of the first driving wire 31 is fixed to the pulley 25, and as illustrated in FIG. 2, a portion adjacent to the other end of the first driving wire 31 is wound around an outer circumferential surface of the pulley 25 or unwound therefrom.

FIGS. 6 and 7 are views illustrating a state in which the first driving wire 31 is installed between the upper end of the tailgate 1 adjacent to a hinge mechanism 2 and the rear door of the vehicle 4. Specifically, FIG. 6 illustrates a state in which the tailgate 1 closes the rear of the vehicle 4 and FIG. 7 illustrates a state in which the tailgate 1 opens the rear door of the vehicle 4.

Referring to FIGS. 6 and 7, one end of the first driving wire 31 is fixed to an upper roof portion (4*a*) of the vehicle 4 adjacent to the hinge mechanism 2 through the fixture 3, a through hole 1*a* is formed in an upper end adjacent to the hinge mechanism 2, and the first driving wire 31 is configured to pass through the interior of the tailgate 1 through a through hole 1*a* of the tailgate 1. Also, a grommet 5 serving to ensure air-tightness or waterproofing or protect the first driving wire 31 may be installed in the through hole 1*a*.

The hinge mechanism 2 has a vehicle side hinge bracket 2*a* coupled to the rear of the upper portion of the vehicle 4, that is, to a roof panel 4*a* of the vehicle 4*a*, a tailgate side hinge bracket 2*b* coupled to an upper end of the tailgate 1, and a hinge shaft 2*c* provided between the vehicle side hinge bracket 2*a* and the tailgate side hinge bracket 2*b*.

As the tailgate 1 is opened and closed at the rear of the vehicle 4 by the hinge mechanism 2, a distance between the fixture 3 and the through hole 1*a* of the tailgate 1 may be varied, and as a length of the first driving wire 31 in a section positioned between the fixture 3 and the through hole 1*a* of the tailgate 1 is varied, the other end of the first driving wire 31 is wound around the pulley 25 or unwound therefrom.

In detail, when the tailgate 1 is closed in the rear of the vehicle 4, the length of the first driving wire 31 in the section positioned between the fixture 3 and the through hole 1*a* of the tailgate 1 is a first length L1 as illustrated in FIG. 6.

When the tailgate 1 opens the rear of the vehicle 4, a partial section of the first driving wire 31 positioned between the fixture 3 and the through hole 1*a* of the tailgate 1 is a second length L2 greater than the aforementioned first length L1.

In this manner, when the tailgate 1 changes from the closed state to the opened state, as illustrated in FIGS. 6 and 7, the length of the partial section of the first driving wire 31 increases from the first length L1 to the second length L2, and the first driving wire 31 corresponding to the increased length (a difference between the second length L2 and the first length L1) of the first driving wire is pulled so a predetermined length of the first driving wire 31 wound around the pulley 25 is unwound. Here, the first driving wire 31 is unwound in the direction of the arrow K1 of FIG. 2, and due to the unwinding of the first driving wire 31, the pulley 25 rotates in an unwinding direction (UW direction of FIG. 2).

That is, when the tailgate 1 is opened, the first driving wire 31 is pulled and thus the first driving wire 31 is unwound from the pulley 25, and the pulley 25 rotates in the unwinding direction (UW direction of FIG. 2).

One end of the second driving wire 32 is fixed to one side 43*a* of the moving member 43, and the other end of the second driving wire 32 is fixed to one side of the pulley 25, and accordingly, a length of the second driving wire 32 adjacent to the other end of the second driving wire 32 is wound around an outer circumferential surface of the pulley 25 or unwound therefrom.

When the tailgate 1 is opened, the first driving wire 31 is pulled, the pulley 25 rotates in the unwinding direction, and the second driving wire 32 is unwound from the pulley 25.

In this manner, since one end of the second driving wire 32 is fixed to one side 43*a* of the moving member 43, the piston 42 and the moving member 43 are connected to the pulley 25 by the second driving wire 32, and accordingly, a rotational movement of the pulley 25 may be very easily converted into a forward/backward movement of the piston 42.

The pulley 25 is configured to receive circumferential directional elastic force in the winding direction (please refer to direction of the arrow W of FIG. 2) by the second elastic member 29. That is, in a case in which pulling force does not act on the first driving wire 31, a state in which the first driving wire 31 and the second driving wire 32 are wound around the outer circumferential surface of the pulley 25 is maintained by elastic force of the second elastic member 29.

According to an exemplary embodiment, the second elastic member 29 may be configured as a torsion spring applying a circumferential directional elastic force and has a coil portion 29*a* and a pair of legs 29*b* and 29*c* provided at both ends of the coil portion 29*a*. One leg 29*b* of the second elastic member 29 is fixed to the bracket 21 and the other leg 29*c* thereof is fixed to the pulley 25.

As illustrated in FIG. 1, the first driving wire 31 is configured to be guided by a guide structure provided inside and outside the tailgate 1. Such a guide structure may include a plurality of guide rollers and a guide rib installed along a moving path of the first driving wire 31 in the tailgate 1.

As illustrated in FIGS. 2 and 3, the second driving wire 32 is configured to be guided by a guide device provided in the bracket 21. Such a guide device includes a guide rib 23 provided at one side of the bracket 21 and a guide member 24 coupled to the guide rib 23. The guide rib has an installation opening 23*a* in which the guide member 24 is installed, and the guide member 24 has a cylindrical structure in which a guide hole 24*a*, through which the second driving wire 32 is guided, is formed in a central portion thereof.

Figure 4:
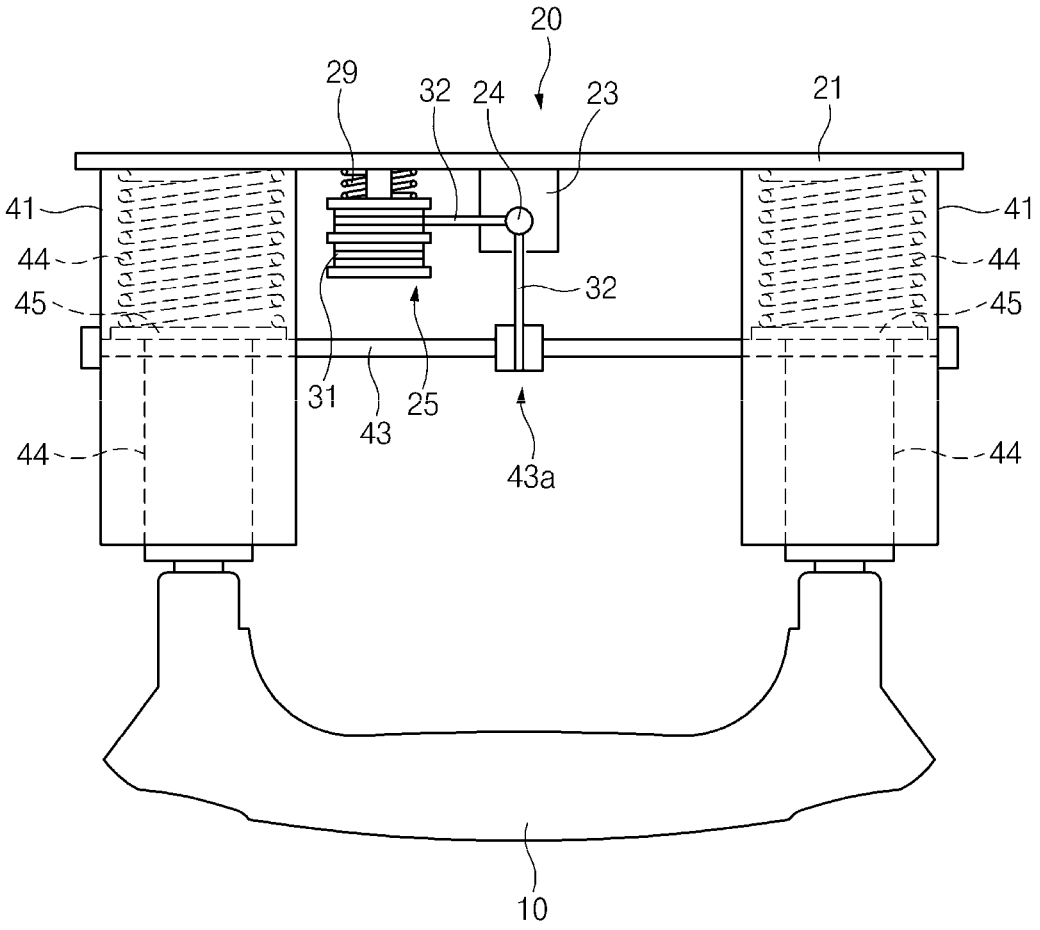
FIG. 4 is a plan view of a tailgate employing a tailgate inner handle assembly according to an exemplary embodiment of the present disclosure, illustrating a state in which a grip member of the inner handle assembly has been moved to a second position.
Figure 5:
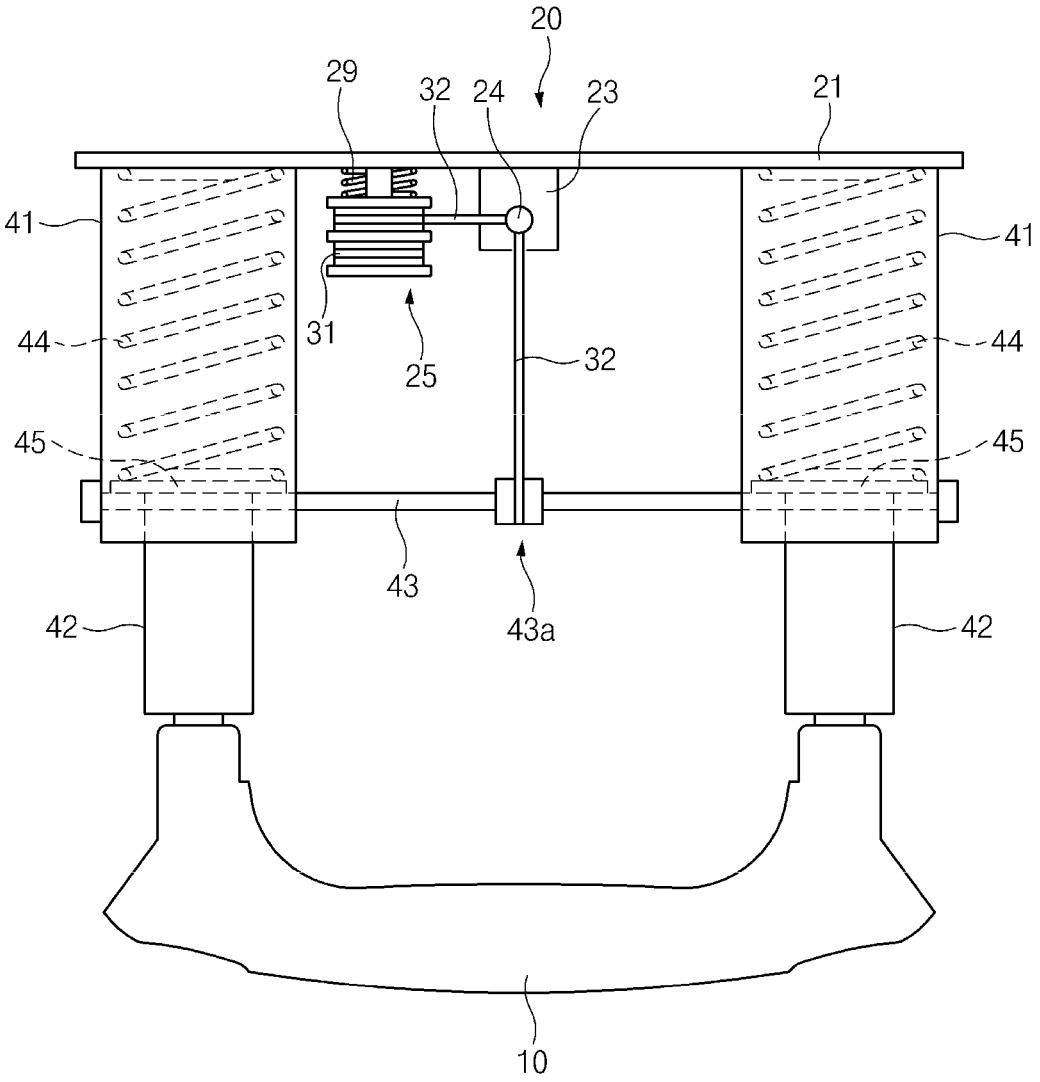
FIG. 5 is a plan view of a tailgate employing a tailgate inner handle assembly according to an exemplary embodiment of the present disclosure, illustrating a state in which a grip member of the inner handle assembly has been moved to a first position.

In particular, as illustrated in FIGS. 4 and 5, the guide rib 23 and the guide member 24 are positioned in the central portion of the bracket 21 so that the second driving wire 32 may be disposed in a direction perpendicular to the fixing unit 43*a* of the moving member 43, and accordingly, the second driving wire 32 may be more stably pulled or released.

A first winding portion 25*a* and a second winding portion 25*b* are divided by a partition wall 27 on an outer circumferential surface of the pulley 25. The first driving wire 31 is wound around the first winding portion 25*a*, and the second driving wire 32 is wound around the second winding portion 25*b*. In this manner, due to the structure in which the first and second winding portions 25*a* and 25*b* are divided on the outer circumferential surface of the pulley 25, each of the first and second driving wires 31 and 32 may be smoothly and stably wound around the outer circumferential surface of the pulley 25 or unwound therefrom.

An operational state of the tailgate inner handle assembly according to an exemplary embodiment of the present disclosure configured described above will be described with reference to FIGS. 1 through 5.

When the tailgate 1 is closed (please refer to FIG. 6), the pulley 25 rotates in the winding direction (please refer to the direction of the arrow W of FIG. 2) due to the circumferential directional elastic force of the second elastic member 29, and accordingly, the first driving wire 31 and the second driving wire 32 are wound around the outer circumferential surface of the pulley 25 (please refer to the directions of the arrows K2 and S2 of FIG. 2).

When the second driving wire 32 is wound around the second winding portion 25*b* of the pulley 25, as illustrated in FIG. 4, the second driving wire 32 pulls back the moving member 43, and when the moving member 43 is pulled back, the piston 44 moves backward and the first elastic member 44 is compressed against elastic force thereof.

Due to the backward movement of the piston 42, as illustrated in FIG. 4, the grip member 10 moves to be closer to the bracket 21 and moves to a second position in the lower end of the tailgate 1.

Thereafter, when the tailgate 1 is opened (please refer to FIG. 7), a length of a partial section of the first driving wire 31 is increased by a predetermined amount (L2−L1), and as the first driving wire 31 is pulled to correspond to the increased length of the first driving wire 31, the first driving wire 31 is unwound from the pulley 25 (please refer to the direction of the arrow K1 of FIG. 2). Due to the unwinding force of the first driving wire 31, the pulley 25, overcoming circumferential directional elastic force of the second elastic member 29, rotates in the unwinding direction (please refer to the direction of the arrow UW of FIG. 2). As the pulley 25 rotates in the unwinding direction, the second driving wire 32 is unwound from the pulley 25 (please refer to the direction of the arrow S1 of FIG. 2).

When the second driving wire 32 is unwound from the second winding portion 25*b* of the pulley 25, pulling the moving member 43 by the second driving wire 32 is aborted and the piston 42 is pushed outward from the bracket 21 by elastic force of the first elastic member 44 so as to move forward.

When the piston 42 moves forward, the grip member 10 moves away from the bracket 21 as illustrated in FIG. 5, and accordingly, the grip member 10 moves to the first position in the lower end of the tailgate 1.

In this manner, when the tailgate 1 is opened, the grip member 10 moves to the first position in the lower end of the tailgate 1, and accordingly, even a short user may easily grab the grip member 10 which is moved to the first position in the lower end of the tailgate 1.

According to the exemplary embodiment of the present disclosure, when the tailgate 1 is opened, since the grip member 10 moves to the first position in the lower end of the tailgate 1 by the driving wires 31 and 32 and the actuator 20, the short user may be able to simply grab the moved grip member 10 to close the tailgate 1, and thus, user convenience may be significantly enhanced.

When the tailgate 1 is closed, since the grip member 10 moves to the second position in the lower end of the tailgate 1 by the driving wires 31 and 32 and the actuator 20, the grip member 10 is prevented from being in contact with other components or loaded items when the tailgate 1 is closed.

In particular, in an exemplary embodiment of the present disclosure, by applying a simple mechanical structure of moving the grip member 10 by driving the actuator 20 by means of the driving wires 31 and 32, an electric component (an electric motor or a sensor) consuming electricity is not used, reducing manufacturing cost and preventing waste of power.

According to the exemplary embodiment of the present disclosure, when the driving wires 31 and 32 are wound around the outer circumferential surface of the pulley 25 or unwound therefrom, the driving wires 31 and 32 are rotated in the winding direction or unwinding direction of the pulley and the cylinder unit 40 moves the grip member 10 according to the bi-directional rotation of the pulley, and thus, the grip member may be stably moved.

According to the exemplary embodiment of the present disclosure, since the piston 42 and the moving member 43 of the cylinder unit 40 are connected to the pulley 25 through the second driving wire 32, a rotational movement of the pulley 25 may be easily converted into a forward/backward movement of the piston 42 and the grip member 10 may be smoothly moved according to the forward/backward movement of the piston 42.

As described above, according to an exemplary embodiment of the present disclosure, when the tailgate is opened, since the grip member moves from the lower end of the tailgate to a first position by the driving wires and the actuator, a short user may be able to simply grab the moved grip member to close the tailgate, and thus, user convenience may be significantly enhanced.

When the tailgate is closed, since the grip member is moved to the second position in the lower end of the tailgate by the driving wires and the actuator, the grip member is prevented from being in contact with other components or loaded items when the tailgate is closed, and thus, the tailgate may be smoothly closed.

In particular, in an exemplary embodiment of the present disclosure, since a simple mechanical structure of moving the grip member by driving the actuator by means of one or more driving wires is applied, an electric component (an electric motor or a sensor) consuming electricity is not used, reducing manufacturing cost and preventing waste of power.

According to an exemplary embodiment of the present disclosure, when the driving wires are wound around the outer circumferential surface of the pulley or unwound therefrom, the driving wires are rotated in the winding direction or unwinding direction of the pulley and the cylinder unit moves the grip member to a first position or the second position according to the bi-directional rotation of the pulley, and thus, the grip member may be stably moved.

According to an exemplary embodiment of the present disclosure, since the moving member of the cylinder unit is connected to the pulley by the second driving wire, a rotational movement of the pulley may be easily converted into a forward/backward movement of the piston and the grip member may be smoothly moved according to the forward/backward movement of the piston.

As described above, although the present disclosure has been described with reference to exemplary embodiments and the accompanying drawings, it would be appreciated by those skilled in the art that the present disclosure is not limited thereto but various modifications and alterations might be made without departing from the scope defined in the following claims.

What is claimed is:

1. A tailgate inner handle assembly comprising:

a grip member being movable in a lower end of a tailgate;

an actuator moving the grip member to a first position when the tailgate is opened and moving the grip member to a second position when the tailgate is closed; and a driving wire driving the actuator when the tailgate is opened or closed, wherein the actuator includes:

a pulley rotating in a first direction when the driving wire is wound, and rotating in a second direction when the driving wire is unwound; and a cylinder device moving the grip member by the pulley rotating in the first direction or in the second direction, the cylinder device includes a cylinder, a piston being installed to move forward and backward with respect to the cylinder, and a moving member being connected to a side of the piston, and wherein the driving wire includes a first driving wire connected from an upper roof portion of a vehicle to the pulley through inside an interior of the tailgate and a second driving wire connected from the moving member to the pulley.

2. The tailgate inner handle assembly according to claim 1, further comprising:

a bracket being fixed to the lower end of the tailgate, wherein the pulley and the cylinder device are installed on the bracket.

3. The tailgate inner handle assembly according to claim 2, wherein the cylinder is installed on the bracket.

4. The tailgate inner handle assembly according to claim 1, wherein the grip member is fixed to the piston, the piston is connected to the pulley by the driving wire, and the piston moves forward and backward by the pulley rotating in the first direction or in the second direction.

5. The tailgate inner handle assembly according to claim 1, wherein the moving member is installed to move forward and backward by integrally operating with the driving wire and the pulley.

6. The tailgate inner handle assembly according to claim 5, wherein the moving member is coupled to penetrate through the piston in a radial direction of the piston and the cylinder has a guide slot guiding forward and backward movement of the moving member in a longitudinal direction of the cylinder.

7. The tailgate inner handle assembly according to claim 6, wherein a first elastic member applying elastic force to the piston is installed in the cylinder.

8. The tailgate inner handle assembly according to claim 7, wherein the first elastic member applies the elastic force in a direction in which the moving member moves away from the bracket.

9. The tailgate inner handle assembly according to claim 8, wherein a retainer is interposed between a first end of the first elastic member and the moving member.

10. The tailgate inner handle assembly according to claim 1, wherein the first driving wire and the second driving wire are wound around an outer circumferential surface of the pulley, and when the tailgate is opened and the first driving wire is pulled, the first and second driving wires are unwound from the outer circumferential surface of the pulley and the moving member and the piston move away from the bracket.

11. The tailgate inner handle assembly according to claim 1, wherein the pulley is installed to rotate in a winding direction when the first and second driving wires are wound or in an unwinding direction when the first and second driving wires are unwound, and the pulley is configured to receive elastic force to rotate in the winding direction by a second elastic member.

12. The tailgate inner handle assembly according to claim 11, wherein the second elastic member is a torsion spring applying circumferential directional elastic force.

13. The tailgate inner handle assembly according to claim 1, wherein the pulley is provided to have a first winding portion in which the first driving wire is wound around an outer circumferential surface thereof and a second winding portion in which the second driving wire is wound around the outer circumferential surface thereof.

14. The tailgate inner handle assembly according to claim 1, further comprising a guide device guiding the second driving wire.

15. The tailgate inner handle assembly according to claim 14, wherein the guide device includes a guide rib provided at a side of the bracket and a guide member coupled to the guide rib, and the guide member has a guide hole in which the second driving wire is guided.

16. A tailgate inner handle assembly comprising:

a bracket being fixed to a lower end of a tailgate;

a pair of cylinders being fixed to the bracket and each having a hollow portion therein;

a pair of pistons being installed to move forward and backward in the hollow portions of the pair of cylinders;

a pair of first elastic members installed within the pair of cylinders and applying elastic force in a direction moving away from the bracket;

a grip member being connected to the pair of pistons;

a moving member being installed between the pair of pistons to connect a first piston to a second piston; and a pulley being installed to rotate in the bracket and allowing a first driving wire and a second driving wire to be wound around an outer circumferential surface thereof, wherein a first end of the first driving wire is fixed to an upper roof portion of a vehicle and a second end of the first driving wire is fixed to be wound around the pulley, and a first end of the second driving wire is fixed to a central portion of the moving member and a second end of the second driving wire is fixed to be wound around the pulley.

* * * * *